175 45 SR
8/19/86 XR 4,606,415

United States Patent [19]

Gray, Jr. et al.

[11] Patent Number: 4,606,415

[45] Date of Patent: Aug. 19, 1986

[54] METHOD AND SYSTEM FOR DETECTING AND IDENTIFYING ABNORMAL DRILLING CONDITIONS

[75] Inventors: Charles L. Gray, Jr.; Herbert A. Rundell; Thomas M. Williams, all of Houston, Tex.

[73] Assignee: Texaco Inc., White Plains, N.Y.

[21] Appl. No.: 672,983

[22] Filed: Nov. 19, 1984

[51] Int. Cl.[4] ..... E21B 21/08; E21B 47/06

[52] U.S. Cl. ..... 175/24; 73/155; 175/38; 175/48

[58] Field of Search ..... 175/24, 25, 38, 48, 175/65; 166/53, 66, 250; 73/155

[56] References Cited

U.S. PATENT DOCUMENTS

| | | | |
|---|---|---|---|
| 3,058,532 | 10/1962 | Alder | 175/25 X |
| 3,324,717 | 6/1967 | Brooks et al. | 175/48 X |
| 3,470,971 | 10/1969 | Dower | 175/25 |
| 3,517,553 | 6/1970 | Williams et al. | 175/25 X |
| 3,595,075 | 7/1971 | Dower | 73/155 |
| 3,726,136 | 4/1973 | McKean et al. | 175/48 X |
| 4,253,530 | 3/1981 | Sharki et al. | 175/25 |
| 4,295,366 | 10/1981 | Gibson et al. | 175/48 X |

*Primary Examiner*—George A. Suchfield
*Attorney, Agent, or Firm*—Robert A. Kulason; James J. O'Loughlin; Ronald G. Gillespie

[57] ABSTRACT

A method and system for detecting and identifying abnormal drilling conditions. It determines the normal pump speed-pressure ratio over the range of usual working conditions. It measures the output pressure from the pump. And it measures the speed of the pump. Then it detects a change from the normal pump speed-pressure ratio which indicates abnormal conditions. Identification of the abnormal condition depends upon whether the pump speed increased above normal or the output pressure decreased below normal. If the former, the volume of drilling fluid returning is observed in order to identify one of three conditions. If the latter, the number of decreases greater than a predetermined extent are counted over a predetermined interval of time which may indicate malfunctioning pump valve or valves.

17 Claims, 3 Drawing Figures

MEMORY
40
EXTERNAL CONTROLS
39
35
36
41
SIGNAL CONDITIONING ELECTRONICS
COMPARISON, LOGIC & CONTROL CIRCUITS
ALARM
42
INDICATOR LIGHTS
43
DIGITAL DISPLAY
33
34
PRESSURE TRANSMITTER
27
30
19
TACH
MUD PUMP
21
24
20
12
11
15
16

TIME
PUMP#2 TURNED ON
PUMP#1 TURNED OFF
49
48
PRESSURE

METHOD AND SYSTEM FOR DETECTING AND IDENTIFYING ABNORMAL DRILLING CONDITIONS

This invention concerns well drilling procedures in general. More specifically the invention concerns a method and/or system for detecting and identifying abnormal conditions during drilling.

Heretofore, it has been common practice to provide pressure instrumentation on the circulating fluid pump system during well drilling, and there are a number of patents dealing with drilling operations wherein the circulating fluid is monitored in various ways. However, there has been no known simple method and/or system for detecting and identifying abnormal drilling conditions with a minimum of condition monitoring during the drilling process. Thus, there is a patent to Arps U.S. Pat. No. 2,925,251 issued Feb. 16, 1960 which deals with an earth well borehole drilling and logging system. It involves means for obtaining information in the vicinity of the drill bit in the bore hole during drilling. The information includes that concerning the electrical characteristics of the earth formation, and the system provides for transmitting both types of information to the surface by means of pressure pulses created down hole and transmitted up the drilling fluid column. It is concerned with interpretation of the pressure pulses as received at the surface.

Another patent is one issued to Brooks, et al., U.S. Pat. No. 3,324,717 dated June 13, 1967. That patent deals with a system and method for optimizing drilling operations. Although it measures fluid pressure and pump speed, it merely makes separate records of these measurements plus additional measurements that are being made during the drilling procedure. It makes parallel recordings of some eight different measurements during a drilling procedure, and attempts to improve the drilling procedures thereby. It does not recognize or deal with the concepts involved in the applicants invention.

Another patent is that to Walther, Jr. et al., U.S. Pat. No. 3,968,844 issued July 13, 1976. That patent has a back pressure valve down hole and a double check valve by-pass in the wall of the drill string above the back pressure valve and near the drill bit. It is concerned with making measurements of static pressure which will indicate when the drilling mud has thinned in the annulus.

Also, there is a patent to Gibson, et. al., U.S. Pat. No. 4,295,366 issued Oct. 20, 1981. That patent is concerned with measuring the volume of drilling fluid return, per se. It has a specially shaped conduit through which the returning circulating fluid flows. It does not make any provision for measuring pressure of the circulating fluid. Therefore, it does not teach or suggest the applicants invention.

BRIEF SUMMARY OF THE INVENTION

The invention is in well drilling wherein a fluid is circulated for removing drilled formation from the hole, and wherein a pump is employed to circulate said fluid. It concerns a method for detecting and identifying abnormal conditions. It comprises the steps of determining the speed-pressure ratio for normal drilling conditions, and measuring the output pressure from said pump. It also comprises measuring the speed of said pump, and detecting a change in said normal speed-pressure ratio whereby an abnormal condition is indicated.

Again briefly, the invention is in well drilling employing circulating mud and having a pump for circulating said mud from a pit adjacent to said well. It concerns a method for detecting abnormal drilling conditions which comprises measuring only the speed and output pressure of said pump whereby said abnormal conditions may be identified.

Again briefly, the invention is in bore hole drilling wherein a fluid is circulated into the hole by a reciprocating pump having valves therewith. The said fluid is returned with cuttings to a mud pit, as the hole is drilled. The invention concerns a method of detecting malfunctions which comprises the steps of continuously measuring the pressure of said circulating fluid prior to its entry into said hole and developing a first electrical signal proportional to said pressure. It also comprises the step of continuously measuring the speed of said pump and developing a second electrical signal proportional to said speed. Also it comprises determining the normal pressure-speed ratio of said first and second electrical signals, and detecting a deviation from said normal ratio. It also comprises actuating an alarm when said deviation is detected.

Once more briefly, the invention concerns a system for detecting abnormal conditions during well drilling employing a circulating fluid for removing cuttings as said well is drilled, and having a pump for circulating said fluid. It comprises means for measuring the output pressure from said pump, and means for measuring the speed of said pump. It also comprises electric signal generating means for each of said output pressure and said speed, and electronic circuit means for receiving said electric signals and for detecting said abnormal conditions.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein:

A system according to the invention is illustrated in FIGS. 1 and 2. FIG. 1 shows a well 11 that is being drilled in a formation 12. A conventional drilling procedure is indicated, and in the illustration there is shown a drill string 15 that has a drill bit 16 at the lower end thereof. The procedure involves a drilling fluid (not shown) that is commonly termed drilling mud. It is circulated by a mud pump 19. The pump 19 picks up the drilling fluid (mud) from a pit or container 20 and circulates it (as indicated by the arrows) from the pump 19 out through a conduit, or path 21 that includes a flexible hose (not shown) that leads to the usual swivel (not shown) at the top of the drill string 15. The drilling fluid, or mud circulates down through the drill string 15 and out through the drill bit 16. It then flows up the annulus of the well 11 and out through a return line, or conduit 24 and back to the pit 20. It will be understood that the drilling mud will pick up and carry the cuttings of the drilled formation and they will flow back up the annulus and through the return line into the mud pit 20 where they tend to settle out. However, as will be discussed in more detail hereafter, some of the cuttings often get carried to the mud pump 19 where they may cause improper seating of the valves (not shown) in the mud pump as it is acting to circulate the mud.

Figure 1:
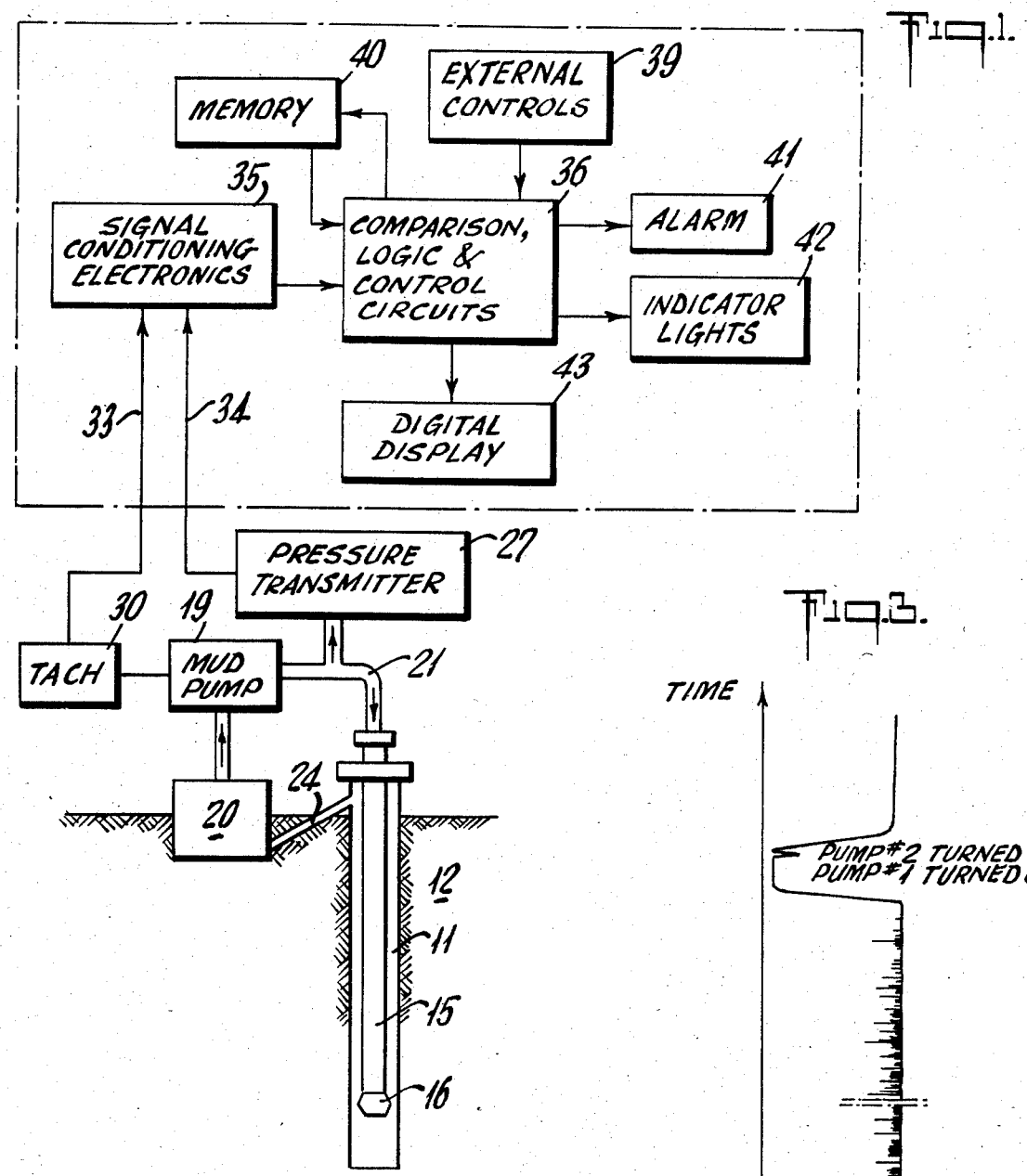
FIG. 1 is a schematic illustration showing the elements of a system to carry out a method and/or system according to the invention.

Connected to the path of the circulating drill fluid near the output of the mud pump 19, there is a pressure transmitter 27 that develops an electrical signal in accordance with the pressure of the circulating fluid, or mud. This transmitter 27 might take various forms, but preferably it is a relatively sensitive yet reliable and ruggedly built pressure transmitter such as one manufactured by Gould Inc., Measurement Systems Division, 2230 Statham Boulevard, Oxnard, Calif., 93033. It is designated a Gould PG3000 Series Gauge Pressure Transmitter.

The only other instrument employed in the mud circulating system is a tachometer 30 that is attached to the mud pump 19 in order to measure the speed of the pump during its operation. As the well 11 is drilled the tachometer 30 and pressure transmitter 27 each develop electrical signals in accordance with the speed and pressure respectively. These signals are transmitted over the circuit connections 33 and 34 respectively which go to signal conditioning electronics 35. The electronics 35 pass signals to comparison, logic-and-control circuits 36, to which external controls 39 are applied. There is a memory element 40 included with the comparison, logic-and-control circuits 36. Also, there is an alarm 41 and there are indicator lights 42 as well as a digital display 43, all of which are controlled from outputs of control circuits 36.

It has been discovered that by making use of only a pressure measurement of the output pressure from the mud pump and a speed measurement of the mud pump during operations, the detection of certain abnormal drilling conditions may be made. Thus, it has been discovered that during a gas influx, a loss of circulation, or a washout, the standpipe pressure (measured by the transmitter 27) will try to decrease because of the decrease in pressure in the system down hole. However, the pump will speed up in order to try to maintain the original operating pressure. Consequently, the tachometer 30 which is monitoring the pump speed, will provide a signal that detects this change. And, the electronic system, i.e., the comparison, logic-and-control circuits 36 will compare the increased speed with the normal speed for that pressure. Consequently, a change from the normal pressure-speed ratio will be detected and an alarm such as the alarm 41 will be actuated. When that has happened the driller may then begin monitoring the fluid level in the mud pit 20 in order to determine which of the foregoing three problems is occurring.

In accordance with the foregoing, a net fluid gain as observed by the fluid level in the mud pit 20, indicates that there has been a gas influx. On the other hand, a net fluid loss indicates a loss of circulation, while no change indicates a washout. It may be noted that by measuring only the speed and output pressure of the pump, the appearance of abnormal conditions is detected and the alarm 41 is actuated. Then when this alerts the driller he will watch the level of mud in the pit 20 and so determine which of the three conditions exists.

Another abnormal condition which may be detected from the pressure transmitter 27 readings, is that concerning the mud pump 19 and the operation of its valve or valves. Formation cuttings sometimes get stuck in a valve seat of the pump and prevent the valve from closing completely. Under those conditions the mud rushes through the opening and will in time erode the valve seat. Such conditions cause large narrow rapidly occurring drops in the pump discharge pressure which pressure is approximately equal to the pressure measured by the transmitter 27.

In order to detect the foregoing valve conditions, the comparison logic and control circuits 36 has a working pressure setting applied so that when the pressure drops or fluctuations occur that go below some preset pressure level, a count of the number of such fluctuations is made. By determining how many of such fluctuations or drops in pressure should be tolerated, a count during a predetermined time interval will provide an indication of trouble if more than the predetermined number takes place. The latter conditions will actuate the alarm 41 and the driller will be alerted. Also by having a separate one of the indicator lights 42 identified, the driller will be directed to that faulty valve indication.

Figure 3:
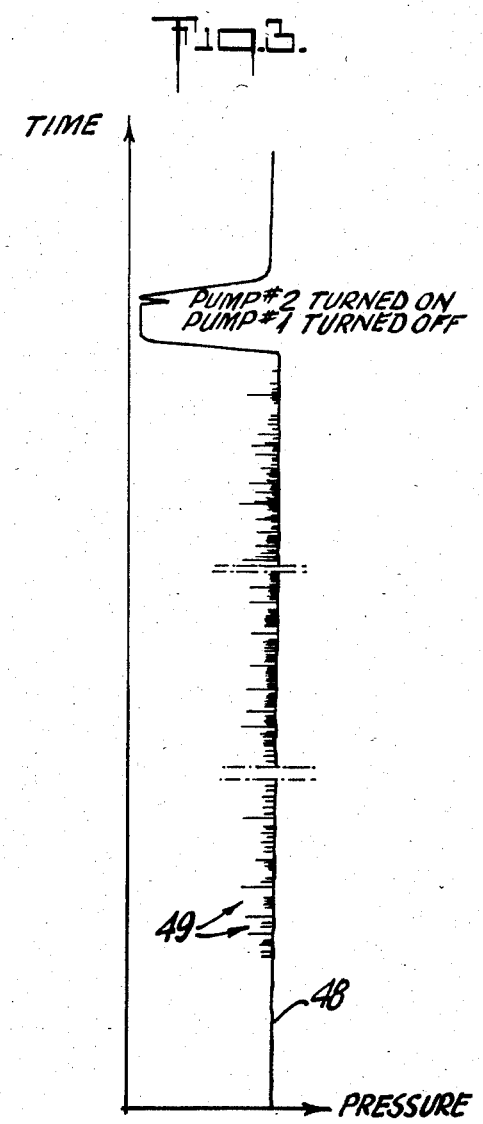
FIG. 3 is an illustration showing portions of a pressure recording taken at the output of a mud pump as it developed improper seating of the valves.

FIG. 3 illustrates a recording of the pressure as read by the transmitter 27 while a faulty valve condition developed. Thus, the amplitude of pressure is shown as the abscissae while time is shown as the ordinates on the FIG. 3 graph. A normal pressure line 48 is the recording of a steady pressure while the pump was operating normally. Then, pressure drops 49 began to appear. Such pressure drops 49 were discovered to be those caused by a faulty valve or valves in the pump. It will be observed that as the pressure recording continued the abnormal pressure drops increased in frequency which indicated that the pump valves were increasingly being held open. Then the pump with the valve disfunction was turned off and another pump turned on in its place. That made a clear indication that the difficulty with the first pump was the valve or valves being held open.

Figure 2:
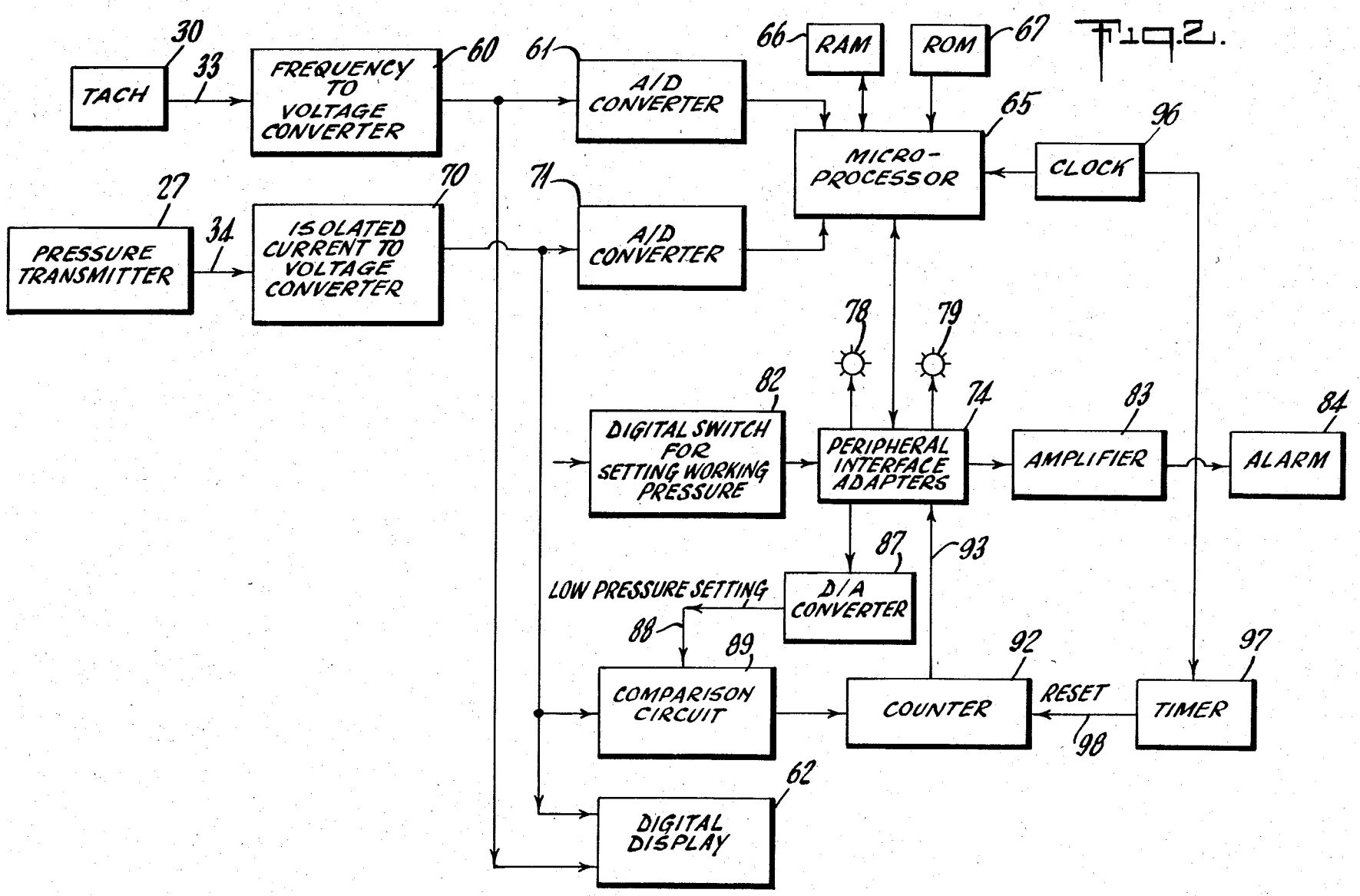
FIG. 2 is a block diagram illustrating elements that may be involved in the electronic circuits in accordance with the system for carrying out a method according to the invention.

FIG. 2 illustrates in block diagram form, elements that are part of the system illustrated in FIG. 1. Thus, the tachometer 30 and the pressure transmitter 27 provide their separate signals over the circuit connections 33 and 34 respectively, as was the case in FIG. 1. In FIG. 2, the speed signal from tachometer 30 goes over the connection 33 to a frequency-to-voltage converter 60. Its output signals go to both an analog-digital converter 61 and to a digital display element 62. There is a microprocessor 65 which has a random access memory 66 and a read only memory 67, both associated therewith.

The pressure transmitter 27 has its output signals go over the circuit connection 34 to an isolated current to voltage converter 70. Converter 70 has its output signals connected to another A/D converter 71 as well as to the digital display element 62. Both of the A/D converters 61 and 71 have their outputs connected into the microprocessor 65 and there are necessary peripheral interface adapters 74 (represented by a single block with caption) that are connected to the microprocessor 65 also.

In connection with the peripheral interface adapters 74 there are two indicator lights 78 and 79 which are for indicating a bad valve or a pressure/speed ratio change respectively. There is a digital switch 82 for setting the working pressure, and there is an amplifier 83 in connection with an alarm 84. Also, there is a digital-to-analog converter 87 that supplies a low pressure signal setting over a circuit connection 88 which goes to a comparison circuit 89. It also receives input signals from the converter 70 so that the pressure signals are compared with the low pressure setting. There is a counter 92 that receives signals from the comparison circuit 89 and applies the number of counts to one of the peripheral adapters 74 over a circuit connection 93.

There is a clock 96 that is connected with the microprocessor 65 and also to a timer 97. In this manner, after a predetermined period of time (as measured by the clock 96) the counter 92 will be reset by an output from the timer 97. That action is indicated by the caption on a connection 98.

METHOD

As noted above, a method according to this invention deals with a well drilling procedure that employs circulating mud and that has a pump for circulating the mud from a pit adjacent to the well. The method employs only measurements of the speed and the output pressure of the pump. From those two measurements, abnormal conditions may be identified.

By making the foregoing two measurements, when an increase in the measured speed is detected that is greater than the speed/pressure normal ratio a determination may be made as to the level of the mud in the mud pit. Then, one of three abnormal conditions may be identified in the following manner. One, when the level determination shows an increase in mud pit level, a gas influx is identified as the abnormal condition. Two, when the level determination shows a decrease in the mud pit level, a loss of circulation is identified. And three, when the determination of mud pit level shows no change (but the increase in speed noted above exists), a washout is identified.

The foregoing method may be carried out by a system according to the FIG. 2 illustration. The speed is measured by tachometer 30 and the output pressure from the pump is measured by pressure transmitter 27. These measurements go to the microprocessor 65 where the normal pressure/speed ratio is accounted for by the programming thereof. When the speed exceeds the normal ratio, the indicator light 79 will be illuminated. Then the driller will monitor the mud pit fluid level in order to make the particular determination as to which of the three abnormal conditions exists.

Another abnormal condition is that in relation to the valve or valves of the pump while the system is in operation. In such case the pressure transmitter 27 will indicate sudden pressure drops as has been described above. These pressure drop signals are connected into the microprocessor 65 where they are compared with the speed. The pressure signals are also fed directly from converter 70 into the comparison circuit 89. Here the pressure signals from the converter 70 are compared with the predetermined low pressure setting which is calculated by the microprocessor 65 from the working pressure that is dialed in by the operator via the digital switch 82. That calculated low pressure setting is sent via one of the peripheral adapters 74 and D/A converter 87 to the comparison circuit 89 over circuit connection 88. When the pressure transmitter signals are lower than the low pressure setting, outputs will go into the counter 92. Then the counts are transmitted via another of the peripheral adapters 74 to the microprocessor 65. At the same time the timer 97 is running and at preset time intervals it will reset the counter 92. The microprocessor 65 will read the counts from the counter 92 before the counter 92 is reset. In this way, whenever a predetermined number of counts are made within the preset time interval, the other indicator light 78 will be illuminated to show bad valve conditions.

It will be noted that a system according to this invention provides a means for carrying out a multi-purpose mud system monitor for use with a drilling well. Thus, an alarm is given if either abnormal speed or pressure drops are detected. In the former case one of the three possible conditions are indicated. Then it is a simple matter for the driller to continue drilling while noting the drilling mud level. From that observation, one of the three conditions described above may be determined. In the latter case, a fourth condition is indicated by an alarm accompanied by an indicator light if the pressure reductions exceed a predetermined level for a predetermined number of times during a given interval. Such fourth condition is an indication of leaky valves in the mud pump.

While particular embodiments of the invention have been described above in considerable detail in accordance with the applicable statues this is not to be taken as in any way limiting the invention but merely being descriptive thereof.

We claim:

1. In well drilling wherein a fluid is circulated for removing drilled formation from the hole and wherein a pump is employed to circulate said fluid, a method for detecting and identifying abnormal conditions, comprising determining the speed-pressure ratio for normal drilling conditions, measuring the output pressure from said pump, measuring the speed of said pump, and detecting a change in said normal speed-pressure ratio whereby an abnormal condition is indicated.

2. In well drilling according to claim 1 wherein said method also comprises identifying said detected abnormal condition.

3. In well drilling according to claim 2, wherein said step of identifying comprises detecting an increase in said speed, and determining the continuing volume of said circulating fluid whereby one of three abnormal conditions may be identified.

4. In well drilling according to claim 3, wherein said continuing volume determination is a reduction in volume whereby a loss of circulation is identified.

5. In well drillling according to claim 3, wherein said continuing volume determination is an increase in volume whereby a gas influx is identified.

6. In well drilling according to claim 3, wherein said continuing volume determination is no change in volume whereby a washout is identified.

7. In well drilling according to claim 2, wherein said step of identifying comprises detecting decreases in said output pressure exceeding a predetermined extent, and counting the number of said decreases in a predetermined length of time whereby faulty pump valve condition is identified.

8. In well drilling employing circulating mud and having a pump for circulating said mud from a pit adjacent to said well, a method for detecting abnormal drilling conditions, comprising measuring only the speed and output pressure of said pump whereby said abnormal conditions may be identified.

9. In well drilling according to claim 8, wherein said method also comprises detecting an increase in said measured speed, and determining the level of said mud in said pit whereby one of three abnormal conditions may be identified.

10. In well drilling according to claim 9, wherein said step of determining the level shows an increase whereby a gas influx is identified.

11. In well drilling according to claim 9, wherein said step of determining the level shows a decrease whereby a loss of circulation is identified.

12. In well drilling according to claim 9, wherein said step of determining the level shows no change whereby a washout is identified.

13. In borehole drilling wherein a fluid circulated into the hole by a reciprocating pump having valves therewith causes said fluid to be returned with cuttings to a mud pit as the hole is drilled, a method of detecting malfunctions comprising the steps of continuously measuring the pressure of said circulating fluid prior to its entry into said hole and developing a first electrical signal proportional to said pressure, continuously measuring the speed of said pump and developing a second electrical signal proportional to said speed, determining the normal pressure-speed ratio of said first and second electrical signals, detecting a deviation from said normal ratio, and actuating an alarm when said deviation is detected.

14. In borehole drilling according to claim 13, wherein said detecting a deviation comprises determining a reduction of said circulating fluid pressure below a predetermined level, and counting the number of said reductions during a predetermined interval.

15. In borehole drilling according to claim 13, wherein said detecting a deviation comprises determining an increase in said speed beyond said normal pressure-speed ratio.

16. In borehole drilling according to claim 15, further comprising the step of monitoring said fluid level in said mud pit whereby one of three malfunctions may be determined.

17. A system for detecting abnormal conditions during well drilling employing a circulating fluid for removing cuttings as said well is drilled and having a pump for circulating said fluid, comprising means for measuring the output pressure from said pump;

means for measuring the speed of said pump;

electric signal generating means for each of said output pressure and said speed; and electronic circuit means for receiving said electric signals and for detecting said abnormal conditions;

said electronic circuit means comprises microprocessor means having randon-access and read-only memories associated therewith, means for setting a low pressure value, means for comparing said output pressure signal with said low pressure value, means for counting the number of times said output pressure signal falls below said set low pressure value during a predetermined interval of time, and means for indicating when said number exceeds a predetermined quantity whereby a leaking valve in said pump is detected.

* * * * *